United States Patent [19]

Polcer

[11] Patent Number: 5,005,529

[45] Date of Patent: Apr. 9, 1991

[54] MODULAR HEAT RECOVERY STEAM GENERATOR HAVING PARALLEL OFFSET HEADERS

[75] Inventor: John Polcer, Morris, N.J.

[73] Assignee: Foster Wheeler Energy Corporation, Clinton, N.J.

[21] Appl. No.: 513,416

[22] Filed: Apr. 23, 1990

[51] Int. Cl.[5] ..... F22B 15/00; F22B 25/00

[52] U.S. Cl. ..... 122/235.15; 29/890.051; 122/7 R

[58] Field of Search ..... 122/235.15, 7 R, 7 B; 29/890.03, 890.051

[56] References Cited

U.S. PATENT DOCUMENTS

| | | | |
|---|---|---|---|
| 535,441 | 3/1895 | Buckley | 122/235.15 |
| 4,422,411 | 12/1983 | Thorogood | 122/7 R |
| 4,553,502 | 11/1985 | Dreuilhe et al. | 122/235.15 X |

*Primary Examiner*—Edward G. Favors

*Attorney, Agent, or Firm*—Marvin A. Naigur

[57] ABSTRACT

A modular type heat recovery steam generator (HRSG) utilizes multiple pairs of parallel offset upper headers and into which at least two rows of vertically-oriented tubes are connected also to a lower header. The upper headers in each pair are offset from each other by a distance equal to the overall width of up to four rows of tubes, and the tubes connected to each header of the pair are located on opposite sides of the headers. Also, the adjacent end of each header pair overlap each other by a distance equal 0.5–2 times the spacing between adjacent tubes. The header arrangement and tube configuration of each module provides a generator assembly which is compact and facilitates fabrication and installation of the modular generator assembly.

10 Claims, 4 Drawing Sheets

MODULAR HEAT RECOVERY STEAM GENERATOR HAVING PARALLEL OFFSET HEADERS

BACKGROUND OF THE INVENTION

This invention pertains to heat recovery steam generators, and pertains particularly to modular type steam generators utilizing multiple pairs of parallel offset headers having tubes attached to alternate sides of each pair of upper and lower headers.

Heat recovery steam generators (HRSG) are used to provide efficient utilization of the heat content from exhaust gases of stationary gas turbines, such as used for electrical power generation. By extracting heat from the turbine hot exhaust gas, the HRSG produces steam which is used for various purposes such as for driving steam turbines to produce more electricity or space heating. In such installations, large gas turbines provide a very favorable return on investment. However, large gas turbines require large heat recovery steam generators, which generally exceed maximum dimensional limits for overland shipping of shop manufactured units. Usual alternatives to field construction for such a heat recovery steam generator are not economical, as an important factor in the favorable economics of such gas turbine installations is that the total time from power plant concept to operation should be short and result in a desirable quick return on investment.

Heat recovery steam generators which could be easily assembled from large, shippable size modules would be economically desirable. However, when such units are attempted, many design complications occur requiring field welding of high boiler pressure headers and tubing, or the addition of costly baffles and structural parts which cause resistance to the exhaust gas flow, thereby adding to the uncertainty of operation, reducing reliability, reducing power production from the gas turbine and adding to costs for heat recovery steam generator (HRSG) installation.

Various arrangements of tubular type heat exchangers for steam generators have been previously developed and used. For example, U.S. Pat. No. 2,336,833 to Badenhausen discloses a conventional waste heat steam generator having multiple vertical parallel tubes each connected to horizontal upper and lower headers. U.S. Pat. No. 2,926,493 to Poole et al discloses a similar steam generator enclosed within a casing for utilizing waste heat from a gas turbine exhaust. Also, U.S. Pat. No. 4,054,107 to Horlitz, Jr. discloses a compact waste heat steam generator system using serpentine shaped tubes arranged for marine type installations. However, the prior art has apparently not provided a waste heat recovery steam generator which utilizes pairs of horizontal parallel offset headers having vertical tubes to provide shippable modules of factory assembled units for efficient, low cost field installation.

SUMMARY OF THE INVENTION

This invention provides a modular type heat recovery steam generator (HRSG) which utilizes two modules each containing multiple pairs of elongated parallel headers which are offset from each other, with each header pair having at least two rows of vertically-oriented tubes connected to the headers. The tubes connected to each pair of headers are located on a side opposite to that of the tubes in the adjacent parallel offset header. Also, the adjacent ends for each pair of parallel offset headers are substantially flat and overlap each other by a distance not exceeding about twice the spacing between the adjacent vertical tubes connected to opposite sides of each header. It will be understood that by utilizing multiple pairs of parallel offset headers in each HRSG module, the width of each module having a desired header length and number of tubes can be significantly reduced. Thus, the pressurized header and tube parts for the heat recovery steam generator (HRSG) are arranged in a casing module so as to have minimal width, which permits each module to be factory constructed, and permits the HRSG to be shipped as separate modules and readily field assembled without incurring the aforementioned problems and high construction costs.

The heat transfer tubes attached to each parallel offset header are arranged in substantially vertical rows, which rows extend across the width of a gas pass within each casing module. Each elongated horizontal offset header is arranged to collect the tube ends from a bank of tube rows which extend across about one-half the width of the total gas pass. The number of the tube rows in such banks will be at least two and could be up to five rows, provided that the header diameter does not exceed the transverse distance between the first and last row of tubes. The upper header can have its centerline arranged over the first row of tubes, while the corresponding bottom header centerline is similarly located under the first row of tubes, so as to provide a heat exchange panel. For header pairs each preferably having four rows of vertical tubes, a left side tube bank has its header centerline arranged vertically above the first tube row, and the right side tube bank has its header centerline arranged in alignment with the fourth tube row. The tubes in the intermediate or remaining rows are formed with the necessary bends at upper and lower ends to suit the desired configuration for the heat exchange panel. Alternately, if desired, heat exchange panels can have the lower header located below the last row of tubes. In this way, the desirable alignment of the tubes in each row is maintained while staggering and overlapping the tube headers.

The header outside diameter will be determined by fluid flow and pressure drop considerations, and will usually not exceed the lateral distance between the first and last row of tubes. The headers of one module are not only adjacent and parallel to and offset from the headers of the next modules, but the capped or enclosed ends of the header pairs also overlap each other, thereby allowing modular type shop construction and field installation of each heat recovery generator module, while achieving proper alignment of the heat transfer tube rows across the entire gas pass.

This modular type heat recovery steam generator having multiple pairs of parallel offset headers with overlapped header ends advantageously permits shop construction of modules and field installation while maintaining minimum total cost, because it avoids costly extra elements and work for the generator installation, and permits such units to be provided at more competitive prices.

BRIEF DESCRIPTION OF DRAWINGS

The invention will be described with reference to the following drawings, in which.

DESCRIPTION OF INVENTION

Figure 1:
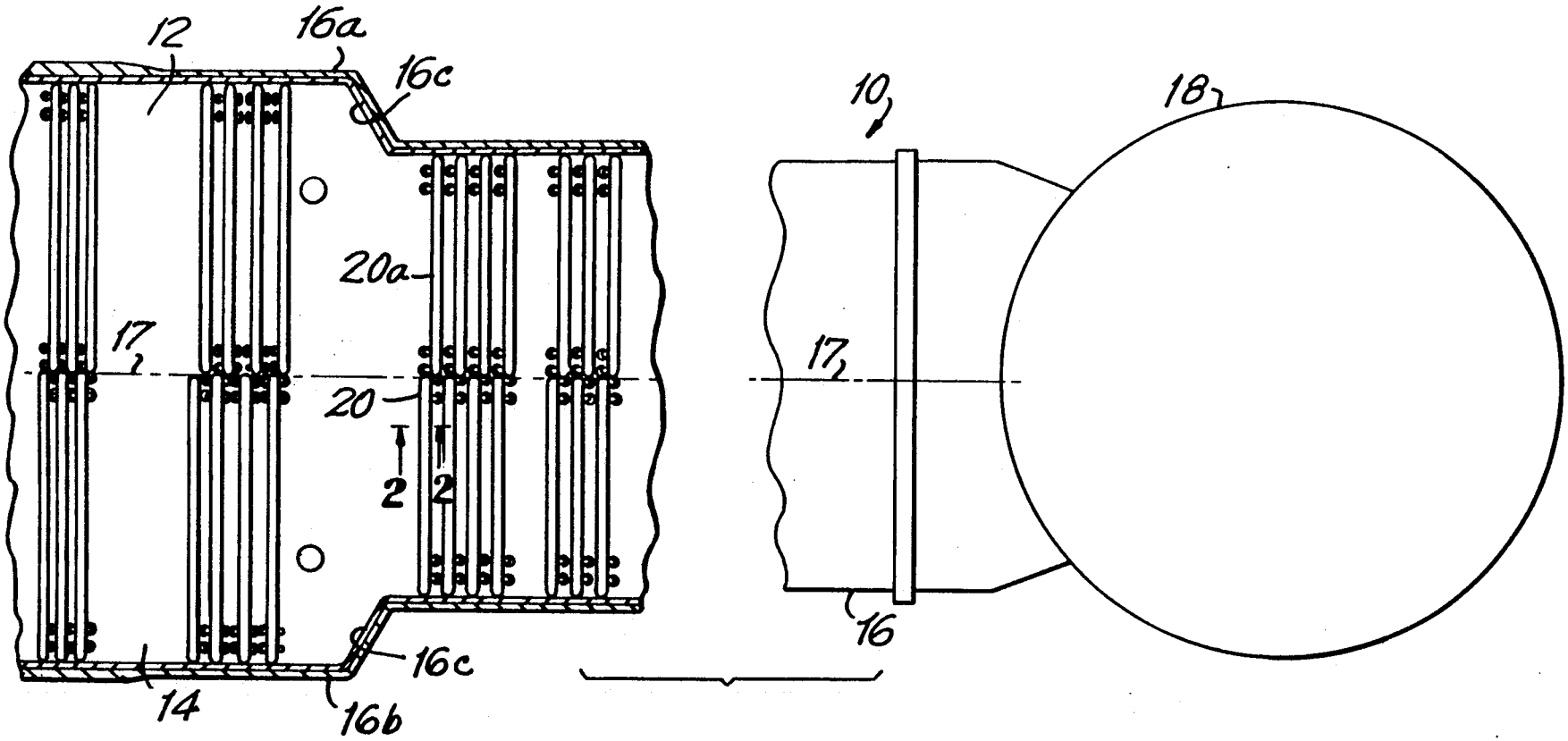
FIG. 1 shows a partial plan view of a modular type heat recovery steam generator installation having multiple pairs of parallel offset headers each connected to vertically-oriented tube banks within adjacent casing modules according to the invention.

As generally shown in FIG. 1, a modular type heat recovery steam generator assembly 10 is formed by two adjacent modules 12 and 14, which each contain multiple upper and lower headers connected to tubes, as described below. The modules 12, 14 are each located closely adjacent to each other within its own portion 16*a*, 16*b* of casing 16, which is connected to a stack 18 carrying a hot gas such as from a gas turbine (not shown) to the stack. The two parallel modules 12 and 14 are each shop fabricated and may include the half casings 16*a*, 16*b* which are left open along their mating side 17, and each casing may be lined with thermal insulation 16*c*. The modules 12 and 14 are shipped separately, then joined together along common mating side 17 at field installation to provide the heat recovery generator assembly 10.

Each module 12 and 14 contains multiple pairs of parallel upper headers 20, 20*a* and lower headers 30, 30*a*, which headers are offset from each other and are each enclosed within a portion of the casing 16 connected to vertical stack 18. As shown in greater detail in FIG. 2, each upper header 20, 20*a*, is provided with four rows of vertically-oriented finned type tubes 22, 24, 26 and 28, which are each connected pressure-tightly to the upper headers 20, 20*a* and are also each similarly connected to lower headers 30, 30*a*, so as to form heat exchange panels 32 and 32*a*.

Figure 2:
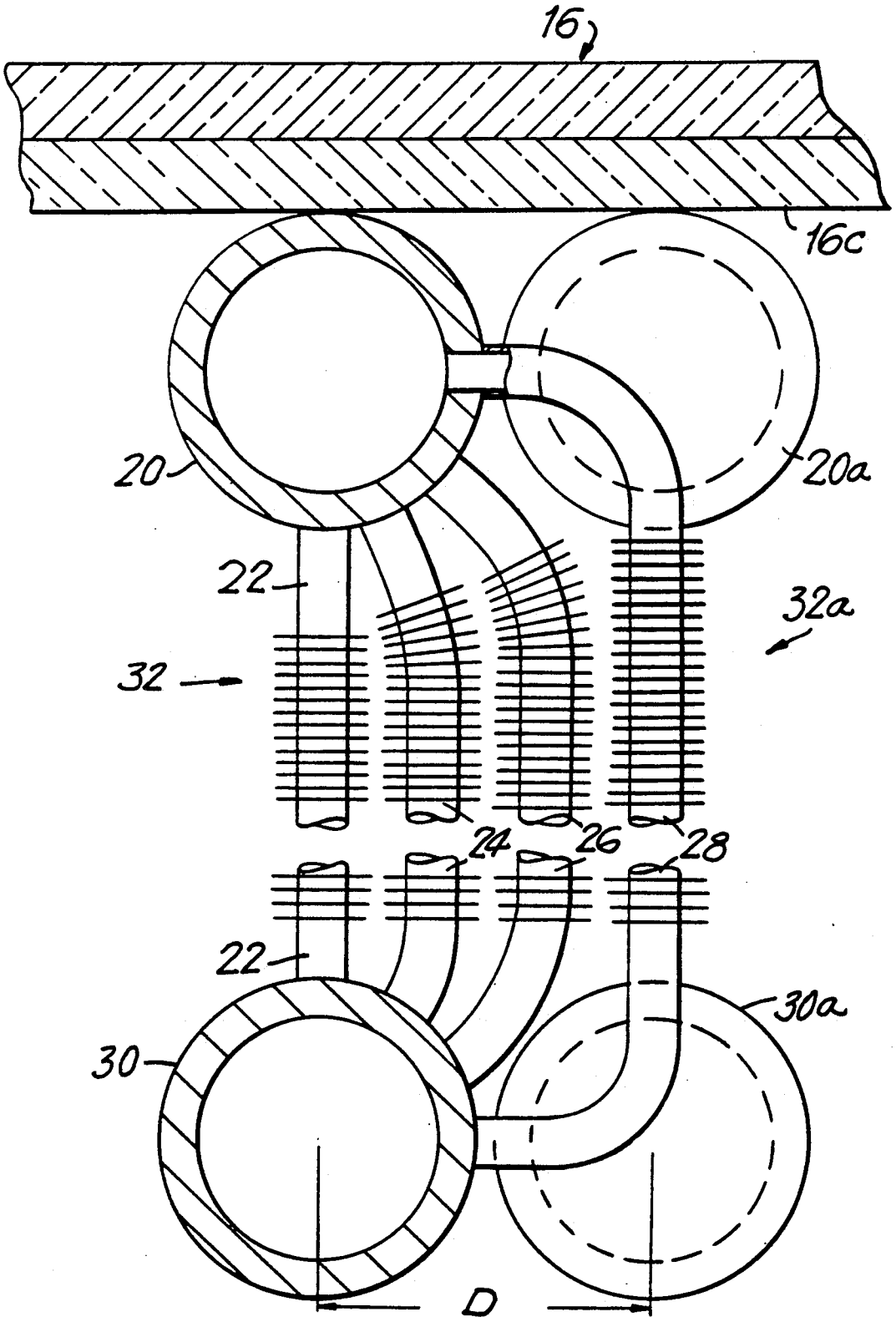
FIG. 2 shows a partial elevational view of a modular steam generator having parallel offset upper and lower headers taken at line 2—2 of FIG. 1, and having four tubes connected to each header.
Figure 3:
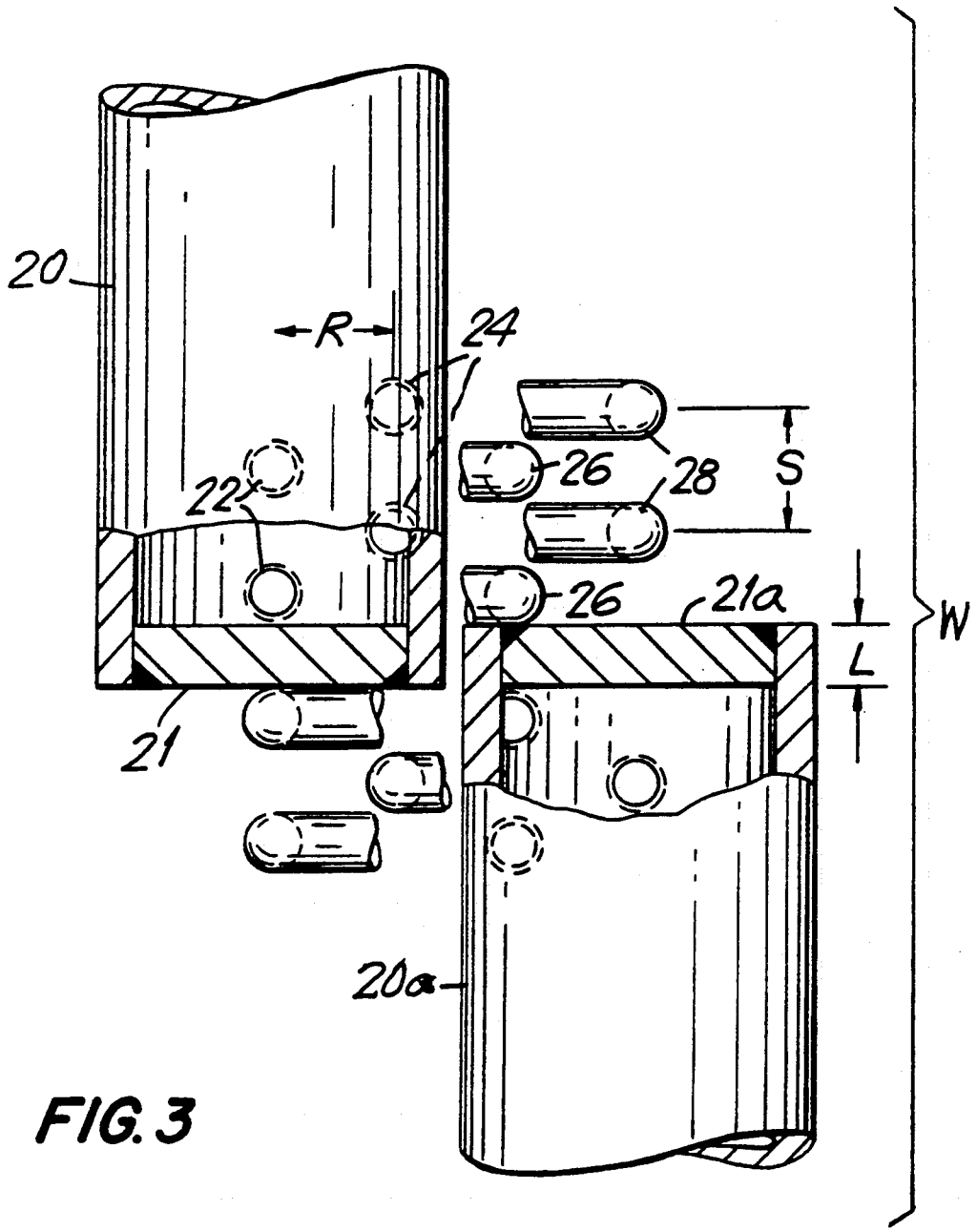
FIG. 3 shows a partial plan view detail of a typical pair of parallel offset and overlapping upper headers with vertical tubes connected to opposite sides of the headers.

The parallel header pairs 20 and 20*a* and their connected tube banks are offset from each other similarly as shown in FIGS. 2 and 3. The lateral spacing D required between adjacent headers 20 and 20*a* depends on the number of tube rows 22, 24, etc. provided for each header and is an appropriate multiple of the lateral spacing "R" between adjacent rows of tubes. The parallel header pair 20, 20*a* and lower header pair 30, 30*a* each have a flat end closure plate 21, 21*a*, which are sealed pressure-tightly by welding. Use of such flat end closures 21, 21*a* for the header pairs permits the end of each header to overlap the end of the adjacent parallel header, and thereby minimize the overall width dimension "W" of the adjacent mating modules 12 and 14. The header pair ends are overlapped by a distance "L" which is at least about 0.5 times the spacing "S" between adjacent tubes in each row 22, 24, etc. and should usually not exceed about 2 times the spacing S between the tubes. Whenever it is desired that the header overlap distance L exceed the regular spacing S between adjacent tubes in a tube row, the first tube nearest each header end plate 21, 21*a* is located so as to accommodate the desired overlap distance L. Use of such offset and overlapped headers permits the tube rows and heat exchange panels 32, 32*a* to be provided in alignment across the gas flow passage in casing 16 so as to assure desired counterflow of hot gases across the tubes and vertical flow of pressurized water and/or steam inside the tubes. This arrangement permits providing a large heat recovery steam generator installation utilizing dual modular type units for a particular heat or steam generation capacity in less time and cost than could be otherwise accomplished.

Depending upon plant capacity and design requirements, the horizontal upper headers 20, 20*a* and lower headers 30, 30*a* are each made 4–24 inch diameter and 3–15 feet long. The vertically oriented tubes in rows 22–28 are usually 1–3 inch diameter and 20–70 feet long. Materials suitable for the headers, vertical tubes, and connecting conduits are carbon and alloy steels approved by ASME code as being appropriate for the particular temeperatures and design stress levels desired.

Figure 4:
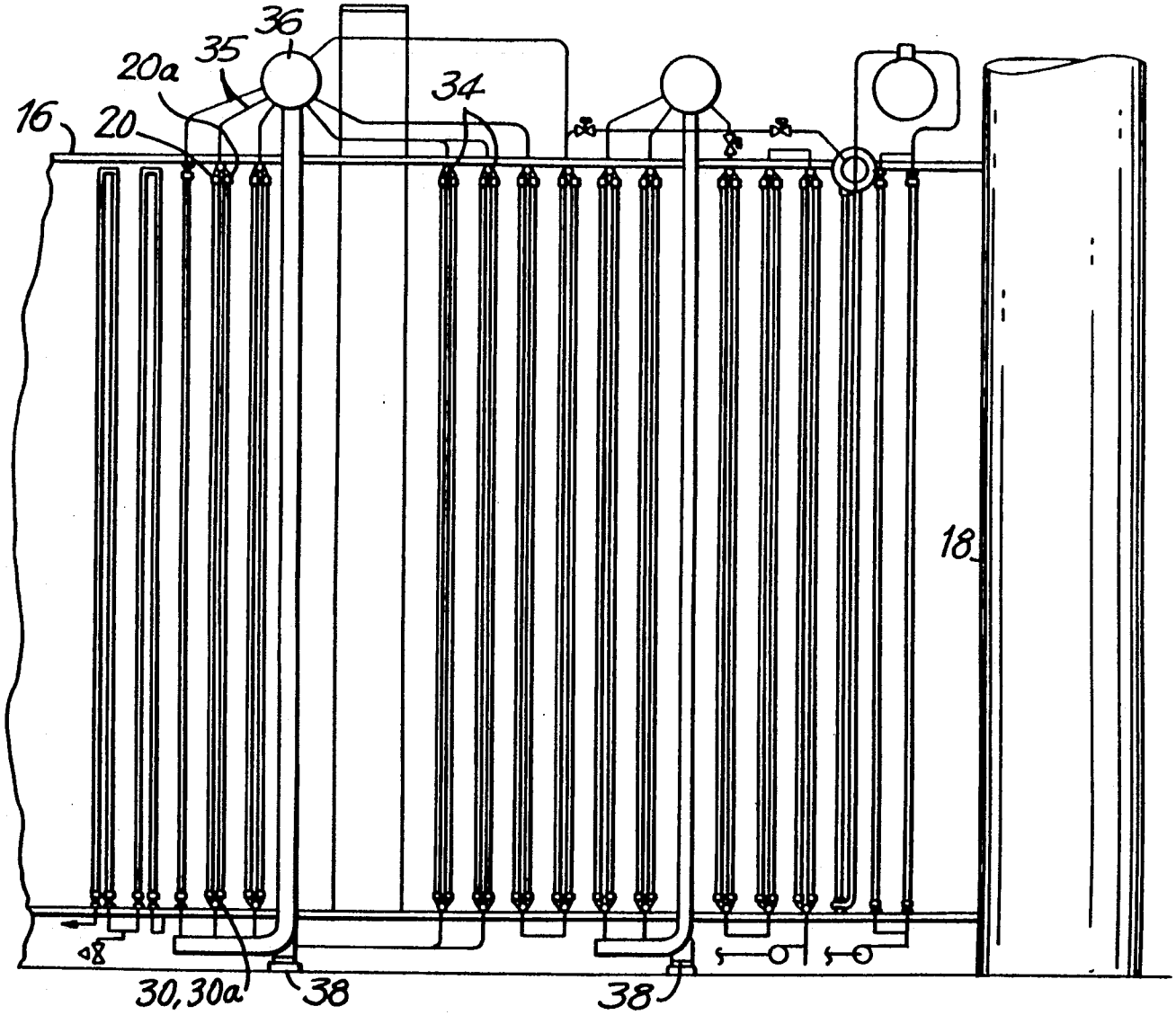
FIG. 4 shows an overall elevational view of a modular heat recovery steam generator assembly utilizing heat exchange panels having multiple pairs of parallel offset headers connected to vertically oriented tubes according to this invention.

As generally shown in FIG. 4, the horizontal headers in each module 12, 14 are connected together by horizontal conduits 34 carrying a heat absorbing liquid such as water in either parallel or series flow arrangements to the lower and upper headers, depending upon the temperature pattern desired in each heat exchanger tube bank. Also, the HRSG modules 12 and 14 each containing multiple offset parallel upper headers 20, 20*a* and lower headers 30, 30*a* having the vertical tubes attached thereto within casing 16 are each connected by conduits 35 to high pressure steam drums 36 located above the casing 16, so as to provide a heat recovery generator assembly and installation according to the invention.

This invention also includes an improved method for installing shippable size modules of a heat recovery steam generator (HRSG) as described above. Each module 12, 14 may be shop fabricated within its own casing portion 16, 16*a*, but leaving a common mating side 17 open. The modules are shipped to the job site and installed on a support base 38, so that the upper and lower header pairs are each offset from each other and their adjacent ends overlap by the desired distances. The module casing portions 16*a*, 16*b* are each connected together along their common mating side 17 and are connected to the stack 18. The headers in each module are connected together by fluid conduits 32, 34 and also connected to a steam drum 36 as desired.

This invention will now be further described by the following Example, which should not be construed as limiting in scope.

EXAMPLE

A modular type heat recovery steam generator (HRSG) is constructed using two adjacent parallel modules for recovery of useful heat from hot gas turbine exhaust gases, so as to generate pressurized steam. Each heat recovery module is shop fabricated including a casing portion extending on three sides, and are shipped to an installation site. The modules are joined together along their open casing side at field installation, by locating each module so that the upper and lower header pairs are offset from each other and also overlap by the design dimensions. Then the various connecting conduits and casing portions are welded together to provide a complete and efficient installation.

The heat recovery steam generator has the following characteristics:

Header outside diameter, in. 12

Header length, ft. 10
Header offset distance, in. 14
Header end overlap, in. 2–2.5
Tube outside diameter, in. 2.0
Tube spacing in each row, in. 4.5
Tube length, ft. 40–50
Casing module width, ft. 12
Casing total width, ft. 24
Casing height, ft. 42–50
Gas inlet temperature, ° F 900
Gas outlet temperature, ° F 600
Header internal pressure, psig. 500

Although this invention has been described broadly an in terms of a preferred embodiment, it will be understood that modification and variations can be made within the scope of the invention as defined by the following claims.

I claim:

1. A modular heat recovery generator utilizing at least two parallel upper and lower pressurizable headers each connected together by tubes, which generator comprises:

a horizontally extending casing;

a first elongated pressurizable upper header extending horizontally and transversely within said casing;

at least two rows of vertically-oriented tubes each connected pressure-tightly to said first upper header and also connected pressure-tightly to a corresponding elongated lower header; and a second elongated pressurizable upper header located parallel to and offset from said first upper header, said second upper header having at least two rows of vertically-oriented tubes connected pressure-tightly to the second header and also connected pressure-tightly to a corresponding lower header, wherein the tubes connected to said first upper header are located on a side opposite from the tubes connected to said second upper header, and the adjacent ends of said first and second headers overlap each other, so as to provide dual adjacent tube banks within said casing of the modular heat recovery generator assembly.

2. The heat recovery generator of claim 1, wherein four rows of parallel vertically-oriented spaced-apart tubes are connected to each said upper and lower headers.

3. The heat recovery generator of claim 1, wherein the header pair adjacent ends overlap by a distance equal to 0.5–2 times the spacing between the adjacent rows of vertical tubes.

4. The heat recovery generator of claim 1, wherein said first upper and lower headers together with their connecting tubes form a first heat exchange panel.

5. The heat recovery generator of claim 1, wherein said vertically oriented tubes are finned type tubes.

6. The heat recovery generator of claim 1, wherein said headers each have diameter of 4–24 inches and a length of 5–15 feet.

7. The heat recovery generator of claim 1, wherein said tubes are 1–3 inch diameter and 20–70 feet long.

8. The heat recovery generator of claim 4, wherein a plurality of said heat exchange panels are connected to a steam drum.

9. A modular type heat recovery generator having parallel offset upper and lower pressurizable headers connected together by vertically-oriented tubes, the generator comprising:

a horizontally extending casing provided in two parallel parts;

a first elongated pressurizable upper header extending horizontally within a first part of said casing;

four rows of vertically-oriented finned type tubes each tube connected pressure-tightly to said first header and also connected to a corresponding elongated lower header to form a first heat exchanger panel; and a second elongated pressurizable upper header located parallel to and offset from said first upper header, said second upper header having four rows of vertically-oriented finned tubes connected pressure-tightly to the second header and also connected to a corresponding lower header to form a second heat exchanger panel, wherein the tubes connected to said first upper header are located on a side opposite from the tubes connected to said second upper header the adjacent ends of said upper and lower panels overlap each other, so as to provide dual adjacent heat exchanger panels within said casing of the modular heat recovery generator assembly.

10. A method for installing a heat recovery generator, comprising:

(a) providing a first heat exchanger module including parallel upper and lower pressurizable headers each having tubes connected to said headers all on one side of the headers;

(b) providing a second heat exchange module including upper and lower pressurizable headers and having tubes provided on the header side opposite those for said first module, and erecting said second module so that the headers are offset from the headers in said first module and having adjacent ends of the headers overlapping the adjacent end headers of said first module; and (c) connecting together casing members for each module so as to enclose said first and second modules to provide a compact heat recovery generator.

* * * * *